United States Patent [19]

Ginzburg et al.

[11] Patent Number: 4,656,905

[45] Date of Patent: Apr. 14, 1987

[54] SHEARING APPARATUS

[75] Inventors: Vladimir B. Ginzburg, Pittsburgh; Robert H. Ellis, Oakmont, both of Pa.

[73] Assignees: Wean United, Inc.; International Rolling Mill Consultants, Inc., both of Pittsburgh, Pa.

[21] Appl. No.: 719,386

[22] Filed: Apr. 2, 1985

[51] Int. Cl.[4] ..... B26D 1/62

[52] U.S. Cl. ..... 83/337; 83/341; 83/305; 83/543; 83/574; 83/694

[58] Field of Search ..... 83/344, 337, 345, 341, 83/548, 543, 574, 639, 674, 694, 701, 304, 926 H, 301, 305

[56] References Cited

U.S. PATENT DOCUMENTS

| | | | |
|---|---|---|---|
| 1,910,387 | 5/1933 | Hahn | 83/344 X |
| 2,568,333 | 9/1951 | Henschker et al. | 83/341 |
| 4,058,041 | 11/1977 | Ho | 83/305 |
| 4,112,798 | 9/1978 | Yoshizawa et al. | 83/344 |
| 4,179,958 | 12/1979 | Nomura et al. | 83/344 X |
| 4,444,076 | 4/1984 | Terai et al. | 83/316 |

*Primary Examiner*—James M. Meister
*Assistant Examiner*—John L. Knoble
*Attorney, Agent, or Firm*—Arnold B. Silverman; Suzanne Kikel

[57] ABSTRACT

A shearing apparatus for performing several modes of operation on travelling or stationary material. Two cooperative knife drums, which can be rendered rotatable or non-rotatable, form a gap whose spacing is varied by hydraulic piston cylinder assemblies, one mounted on opposed ends of the upper or bottom drum. The adjustable knife drum is held in a parallel or non-parallel positioning or caused to rock with or without additional high frequency oscillations by controlling and regulating the pressure in the cylinders, while simultaneously moving the upper drum towards the lower drum and/or rotating both drums.

15 Claims, 7 Drawing Figures

FIG. 3A

I - STATIONARY DOWN-CUT SHEAR

CONDITIONS: MATERIAL IS STATIONARY

UPPER KNIFE MOVES DOWNWARDLY

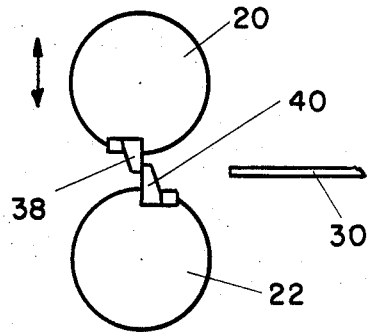

SUB-MODES: a-PARALLEL KNIVES
X MOVEMENT b-NON-PARALLEL KNIVES
X MOVEMENT

C-ROCKING KNIVES
X AND Y MOVEMENTS

FIG. 3B

II-ROTARY SHEARING

CONDITIONS: MATERIAL IS MOVING

BOTH KNIVES ARE ROTATING

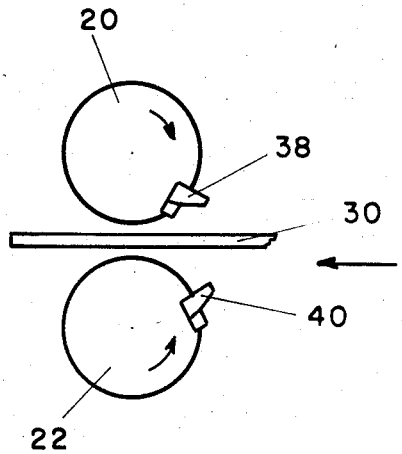

SUB-MODES: a-PARALLEL KNIVES - CYLS. FOR UPPER DRUM INOPERATIVE
Z MOVEMENT b-NON-PARALLEL KNIVES
CYLS. FOR UPPER DRUM INOPERATIVE
Z MOVEMENT

C-ROCKING KNIVES
HIGH FREQUENCY OSCILLATIONS
WITH CYLS. OF UPPER DRUM
Y AND Z MOVEMENTS

FIG. 3C

III – COMBINATION SHEARING

CONDITIONS: MATERIAL IS MOVING

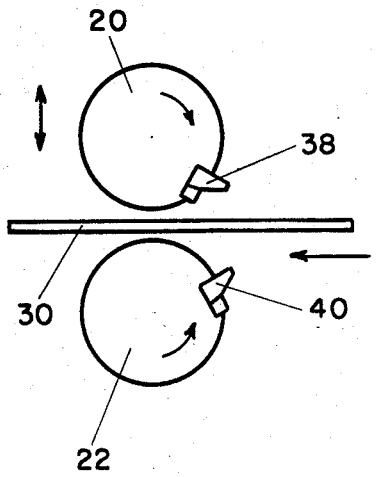

SUB-MODES: a - PARALLEL KNIVES
CYLS. OPERATIVE
X AND Z MOVEMENTS b - NON-PARALLEL KNIVES
CYLS. OPERATIVE
X AND Z MOVEMENTS c - ROCKING KNIVES
CYLS. OPERATIVE PLUS
HIGH FREQUENCY
OSCILLATIONS
X, Y AND Z MOVEMENTS

FIG. 3D

TYPES OF MOVEMENTS FOR KNIVES

X — CYLINDERS IMPART VERTICAL MOVEMENT TO UPPER KNIFE

Y — CYLINDERS IMPART ROCKING MOVEMENT TO UPPER KNIFE

Z — ROTATION OF UPPER AND LOWER KNIVES

SHEARING APPARATUS

BACKGROUND AND SUMMARY OF THE INVENTION

The present invention relates to a device for shearing material generally positioned in a horizontal fashion, which material may take different forms or shaped. More particularly, it concerns replacing most of the conventional types of shearing devices presently used for shearing a traveling or non-traveling product where its thickness, and/or shape varies considerably, or such variations may exist between different workpieces to be sheared.

In producing metallic strip, such as steel or aluminum, an ingot is usually caused to pass through several stands of a rolling mill line, which change the shape and form of the workpiece. A constant problem has existed when a hot bar travels from the last stand of a roughing train into the first stand of a finishing train in that the top and bottom sections of a leading end of the hot bar may separate into what is referred to as an "alligator mouth" making it difficult for the leading end to pass between a crop shear which cuts the leading end off on the fly. In the past it was therefore necessary to force the top and bottom portions together so that the leading end can then easily enter into the gap of a crop shear for severing thereof. If this did not work, then it involved interrupting the travel of the bar to physically removed the bar from the mill, resulting in downtime for the operation of the mill and decreased productivity.

It is therefore an object of the present invention to provide a shearing device designed to easily shear the "alligator mouth" of a leading end off of a workpiece without making it necessary to stop the bar if it is traveling thereby increasing the productivity rate thereof.

Several other types of shearing devices are used in the production of a strip, such as crop shears, down or up cut shears commonly referred to as stationary guillotine shears, rotary shears, and rocking guillotine shears which are specially designed to take into account the operational characteristics of the mill and processing equipment, in addition to the physical condition of a workpiece including its shape and form, and which workpiece may either be moving or in repose. For instance, the ends of a stationary slab may be cut off by a slab shear; a stationary plate/or strip may be sheared to length by a down or an up-cut shear; a stationary plate may be sheared to length by a rocker type shear; or a travelling strip may be sheared by a rotary shear such as a crop shear mentioned previously.

These several shearing devices normally can perform only one particular cutting action and are so vastly different in design and operation as to require in some instances a certain expertise in order to optimize their functioning and efficiency; notwithstanding the high initial expense and operational costs involved in providing the many designs to perform the various shearing operations.

It is therefore a further object of the present invention to provide a simplified shearing device to replace these several different designs which performs one or a combination of the many types of shearing operations regardless of the shape or form of the workpiece whether the workpiece is moving or in repose, thereby eliminating some or all of the disadvantages inherent in providing the several different design shearing devices in a production line for metallic material.

In a broad application, it is a further object of the present invention to provide a simplified shearing device which can be selectively operated to perform a predetermined cut on several different kinds of material simply by controlling the shear's mechanical features so as to produce one or more of its many available modes of operation.

More particularly, two cooperative knives are provided where hydraulic piston cylinder assemblies are connected to one of the knives to initially operate to vertically position this knife in a parallel or non-parallel spaced-apart relationship relative to its cooperative knife, and the pressure in both cylinders may be further controlled during the cutting action to either affect a rocking or rolling motion for the vertically movable drum or a rocking motion combined with relatively higher frequency oscillations. The knives are mounted on rotatable drums and if the material is travelling, the knives are caused to rotate at substantially the same speed as the material to effect a cut on the fly; otherwise, the one drum is vertically moved toward the other knife drum.

And a still further object of the present invention is to provide a shearing apparatus for selectively performing more than one desired cutting action on the same material or different materials offering different shearing characteristics or requirements, comprising a first and second knife holding means arranged on opposite sides of the material to be sheared, an elongated knife means carried by each of said holding means arranged on their respective holding means to cooperate together to effect a cut, means for supporting said holding means in a manner that at least one is movable relative to the other to effect a cut, and power means for causing the opposite ends of said one holding means to selectively assume a parallel or non-parallel condition relative to the material and for causing said relative movement of said one holding means to effect a cut while in one of said assumed positions.

BRIEF DESCRIPTION OF THE DRAWINGS

These objects, features, and advantages of the present invention will be better appreciated and understood from the following detailed description of the preferred embodiment, the appended claims and the accompanying drawings in which:

FIGS. 3A–3C are schematics of the present invention and a diagrammatic analysis illustrating the several principal modes of operation with their sub-modes for effecting different cutting actions;

FIG. 3D is a schematic representing the particular movements of the components of the present invention to effect the different cutting actions.

DETAILED DESCRIPTION OF THE PREFERRED EMBODIMENT

By way of example and for explanation purposes herein, the material to be sheared is either a hot rolled aluminum or a hot rolled steel strip being conveyed to a finishing train of a rolling mill, but it is to be understood that it may be one of several other kinds, sizes, or forms of material being produced or processed by different equipment.

Figure 1:
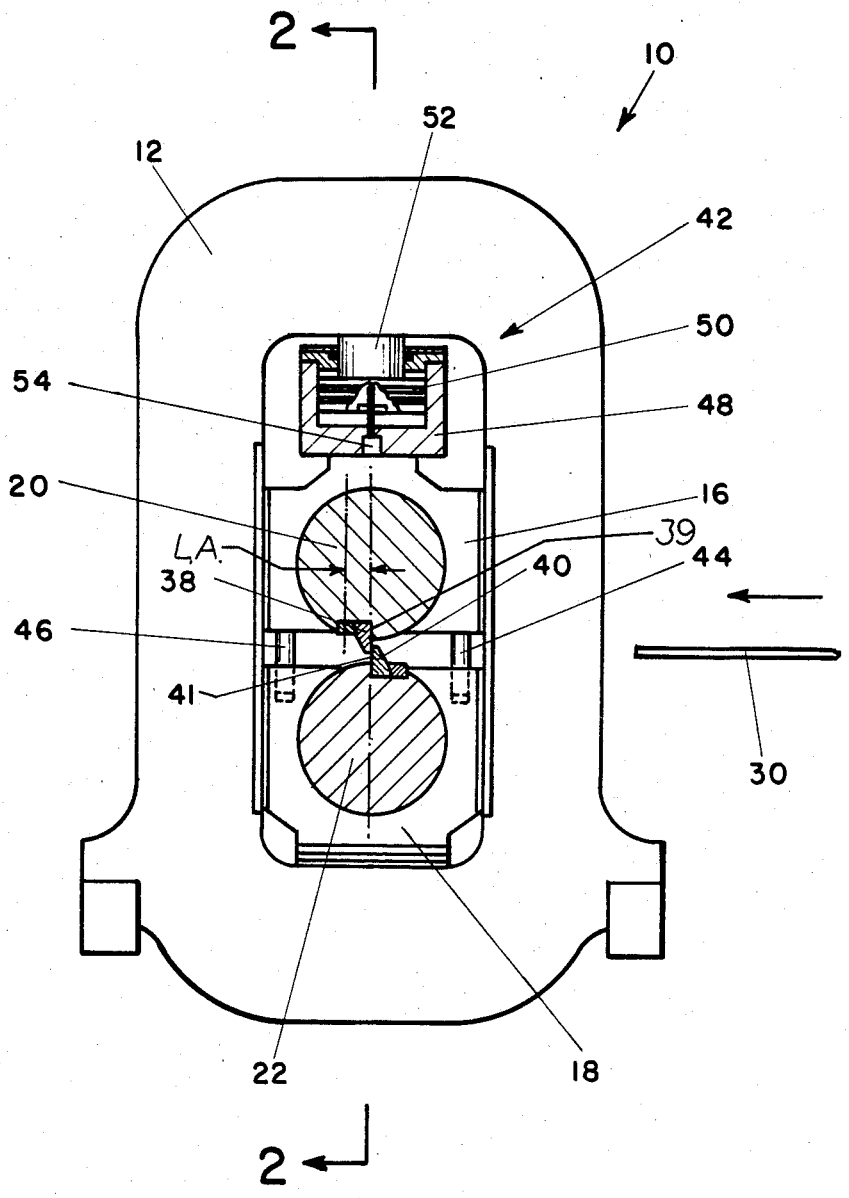
FIG. 1 is a side view, partly in section, of the preferred embodiment of the present invention.

Referring first to FIG. 1, there is shown shearing device 10 comprising housing 12 with a window 14 for receiving and supporting upper and lower bearing chocks 16 and 18 which, in turn carry rotatable drums 20 and 22, respectively. Lower chock 18 is stationarily mounted, after adjusted to its operational position, in liners 24 in window 14, whereas upper chock 16 is mounted in liners 24 for vertical movement relative to lower drum 22, more about which will be discussed shortly.

Figure 2:
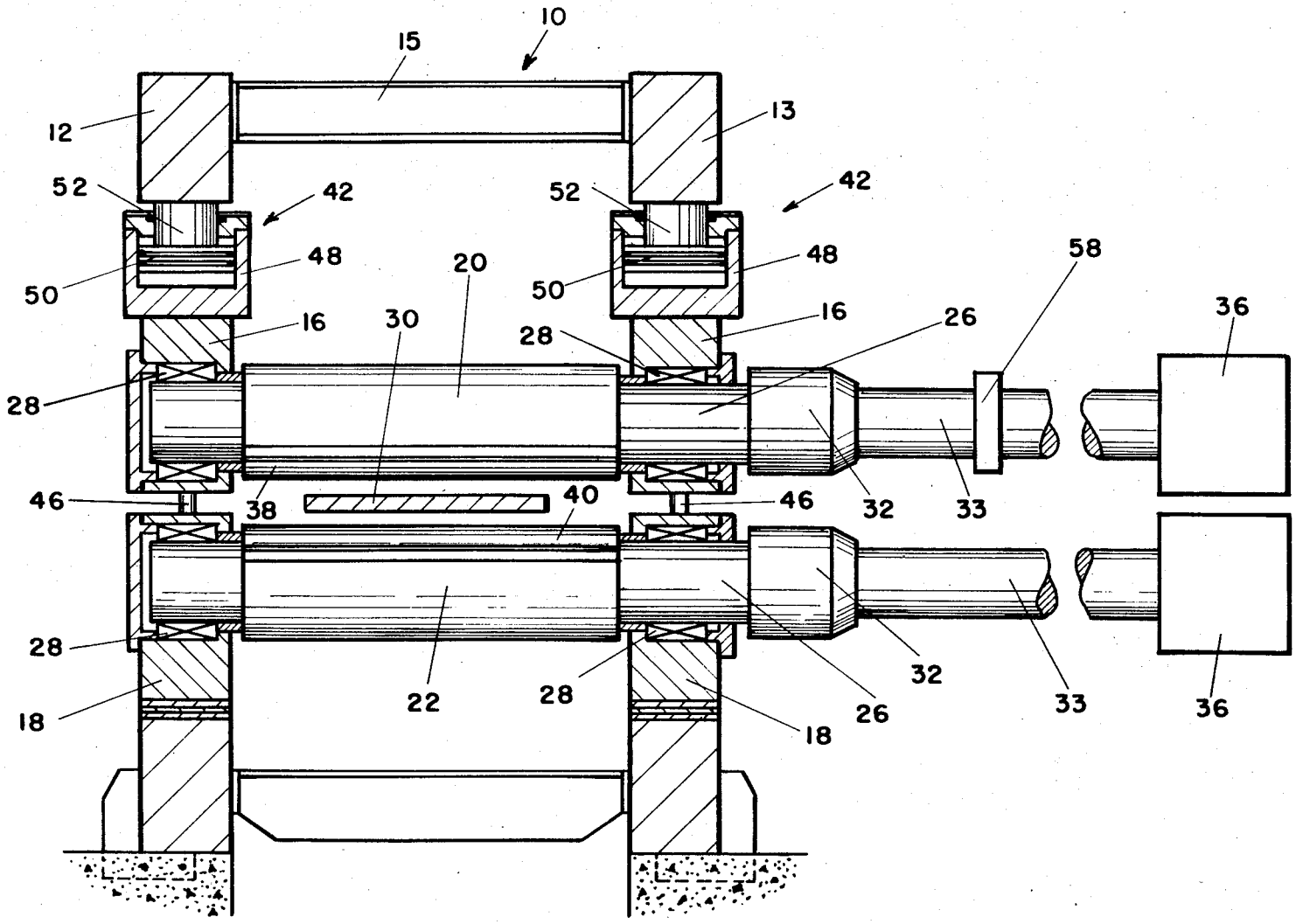
FIG. 2 is a section view taken along lines 2—2 of FIG. 1.

FIG. 2 illustrates that drums 20 and 22 are supported at each of their opposed ends in chocks 16, 18 by shafts 26 extending in bearings 28, which are mounted in similar spaced-apart housings 12 and 13 interconnected by member 15 of shearing device 10. Housings 12 and 13 are mounted on the mill floor and are located transversely across the width of strip 30 so as to permit strip 30 to travel or be positioned in a longitudinal direction as indicated by the arrow in FIG. 1 transversely to the length of drums 20 and 22 (FIG. 2). To the right of FIG. 2 it is shown that coupling 32 is mounted on shafts 26 of upper and lower drums 20, 22 and that each shaft 26 is connected through spindels 33 to a drive assembly 36 for rotation thereof along their respective axis. One of two commonly known types of drive assemblies 36 can be either an independent drive where each spindel 33 is driven by an independent motor (as shown in FIG. 2) or a common drive, where spindels 33 are driven from the same motor through a pinion stand. Mounted in a suitable and well-known fashion in drums 20, 22 are upper and lower knives 38, 40, respectively. These knives 38, 40 are shown to be in a cooperative fashion for a shearing operation and to extend along the length of drums 20, 22 transversely to the positioning of strip 30 between drums 20 and 22 which drums form a gap for receiving strip 30 therebetween. Knives 38 and 40 are of conventional design known in the art to produce a desired shape cut across the width of strip 30.

Connected on upper chocks 16 on each opposed end of upper knife drum 20 is a single or double acting hydraulic cylinder assembly 42 whose pressure and extension are regulated to both effect the shearing stroke and the angular positioning of the upper drum and in cooperation with the balance cylinders to control the distance and the setting of the gap between the two knife drums 20, 22. More particularly, the independent operation of hydraulic cylinder assemblies 42 allow a positioning of the upper drum 20 such that its rotational axis may be held in an initial parallel, vertical plane; or in a non-parallel, vertical plane where an end of upper drum 20 is lower than its opposed end or vice versa; or once the initial gap is set, the cylinder pressure may be constantly varied to produce a rocking motion in upper drum. If desireable the frequency of this varying pressure value can be increased to produce high frequency oscillations in addition to the rocking motion, all of which movements will be further discussed shortly. It is to be appreciated that the FIGS. 1 and 2 only schematically illustrate the degree of travel for cylinders 48, and do not represent an actual displacement thereof.

Between upper and lower knife drums 20 and 22 and mounted in the lower chock 18 are balance cylinders 44 and 46 located opposite each other relative to opposed ends of both the upper and lower drums as shown in FIG. 1, and also located at the extreme other opposed ends of both drums 20 and 22. Balance cylinders 44 and 46 are of conventional design. The primary function of balance cylinders 44 and 46 herein is to maintain the desired separation between knife drums 20 and 22 when the upper drum is not in its shearing stroke. An example of one such balance cylinder suitable for use in the preferred embodiment of the present invention is disclosed in U.S. Pat. No. 3,446,050 which is incorporated herein by reference thereto.

The uppermost predetermined non-shearing position of the drum 20, and the shearing stroke is accomplished through operation of piston cylinder assemblies 42, each consisting of a movable cylinder 48 which abuts against top chocks 16 of upper drum 20; a stationary piston 50 connected to a rod 52 which, in turn, is mounted in the top of its associated housings 12 or 13. Any displacement of upper drum 20 is detected by position transducers, one of which is shown at 54 in FIG. 1. Transducers 54 extend into and between cylinder 48 and piston 50 of each cylinder assembly 42, and are standard commodities readily available in the market. The pressure in each cylinder assembly 42 is detected by pressure transducers (not shown) which are connected to each piston cylinder assembly 42 and which are also standard commodities available in the industry.

Shearing device 10 illustrated in FIGS. 1 and 2 is operated in a manner to perform various modes of operation due to its ability to either rotate or not to rotate knife drums 20 and 22, and to displace upper drum 20 end to end or not while displacing upper drum 20 relative to lower knife drum 22 in a vertical plane as shear 10 is viewed in FIGS. 1 and 2.

Figure 3E:
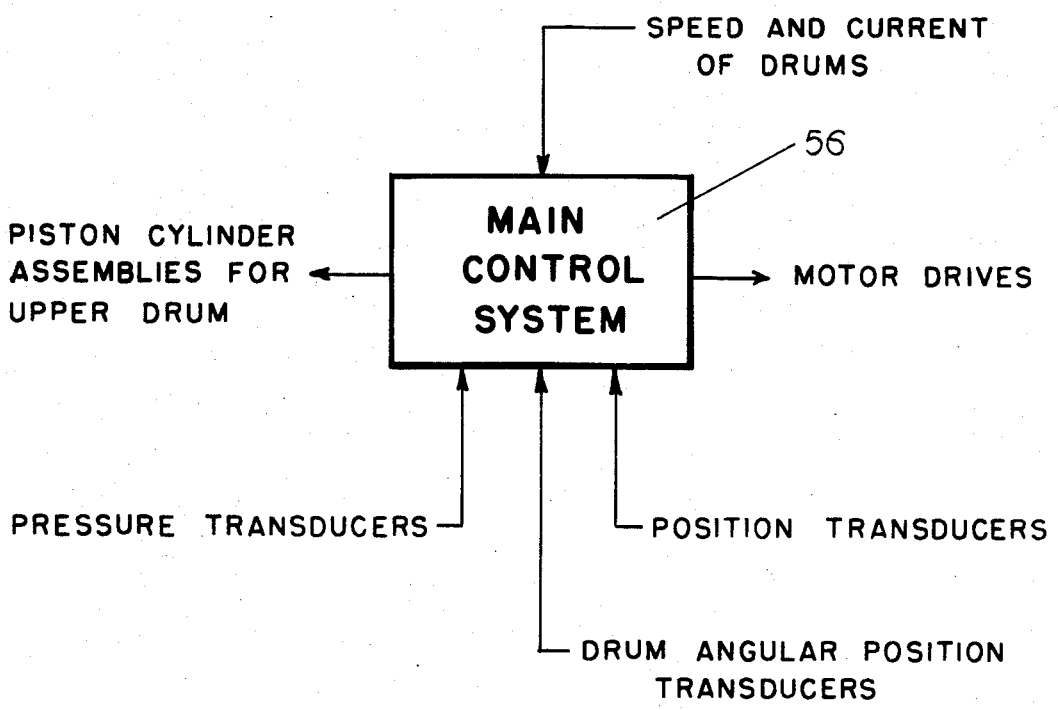
FIG. 3E illustrates the input and output for the control system of the present invention.

The various modes and positioning for upper and lower drums 20, 22 are shown by use of labels and diagrams in FIGS. 3A through FIG. 3D, which are now referred to in explaining the operation of the present invention. A first principal mode of functioning for shearing device 10 is entitled "I-Stationary Down Cut Shear" where strip 30 is held stationary. Knives 38 and 40 are initially set in their cooperative cutting positioning as shown in FIG. 3A, and are not rotated during the cutting process. The double arrow next to upper drum 20 indicates movement thereof in both vertical directions toward and away from lower drum 22.

An initial gap setting permits strip 30 to be positioned between drums 20, 22 and piston cylinder assemblies 42 operate to move upper drum knife 38 downwardly toward lower knife 40 for their cooperative cutting action. As sub-mode Ia labelled "Parallel Knives" indicates in order to effect a straight shearing action evenly across and down through the thickness of strip 30, upper drum 20 is maintained parallel to lower drum 22. When upper knife drum 20 is initially set in a non-parallel positioning relative to lower drum 22 by presetting one of piston cylinder assemblies 42 relative to the other assembly 42, and then lowered down onto strip 30, a raking or diagonal cutting action is effected across the width of strip 30, as shown in sub-mode Ib "Non-Parallel Knives."

A third sub-mode Ic referred to as "Rocking Knives" for this first mode category of shearing operations involves a controlled high frequency change in the displacement of each piston cylinder assembly 42 imparting a rocking motion to upper drum 20 down toward and through the strip 30 where the cutting action creates a progressive rolling action from one end to the other transversely across the width of strip 30, as shown in this sub-mode I(c). In brief, there are three types of movement involved in these sub-modes I(a) through I(c) for this stationary down-cut shearing mode, and which movements are indicated in FIG. 3A by small letters x and y, and which in FIG. 3D shows that the x movement represents vertical movement of upper drum 20 by cylinder assemblies 42, and the y movement represents a rocking motion of upper drum 20 by the same cylinder assemblies 42;

While the present invention is illustrated herein with piston cylinder assemblies 42 associated with chocks 16 of top drum 20; it is to be appreciated that without falling out of the scope and spirit of the present invention, shearing device 10 may be designed to vertically move lower rotatable drum 22 instead, in which instance, similar procedural operations will be performed for lower drum 22 to produce the same cutting actions as those in the preceding explanation for movement of upper drum 20 with the lower drum 22 stationarily mounted.

A second principal mode of operation is shown in FIG. 3B and is referred to as "II-Rotary Shearing". This mode involves cutting of strip 30 upon its travel between drums 20 and 22. Prior to cutting, knives 38 and 40 are positioned as shown in this FIG. 3B so that upon rotation of drums 20, 22, strip 30 can be cut on the fly. Drums 20, 22 are rotated in opposite directions relative to each other in the same direction as the travel of strip 30 as indicated by the arrows. As is well known in the art, for a cutting action, rotation of drums 20, 22 is preferred to be synchronous to the speed of strip 30.

Similarly to the first mode I, in this mode II upper drum 20 is previously positioned either in sub-modes II(a) or II(b) indicating the rotational axis of upper drum 20 to be parallel or non-parallel to that of lower drum 22. However, once this initial positioning is fixed where the spacing between drums 20, 22 is correlated to the thickness of strip 30 and the desired knife overlap, there is no further vertical movement of upper drum 20. The third sub-mode II(c) by varying the pressures in cylinder assemblies 42, imparts a rocking motion to upper drum 20, and the pressure in both cylinder assemblies 42 is controlled through a control system 56 (FIG. 3E, to add high frequency oscillations in a range of approximately 5 to 15 hertz so that upper knife 38 cuts down through strip 30 upon rotation of both drums 20 and 22. As indicated by letters z and y in FIG. 3B the types of movement for sub-modes II(a) through II(c) is rotation of both drums 20, 22 and in addition, a rocking motion for upper knife drum 20 for sub-mode II(c). The oscillations imparted to upper drum 20 is done through an electronic or hydraulic oscillator 58 of a well-known type. (FIG. 2).

FIG. 3C shows a third principal mode of operation for shearing device 10 which entails combining the vertical and rotational movements of upper drum 20, while lower drum 22 rotates. Prior to a cut, knives 38, 40 are rotated to their initial or "home" positions away from the cutting zone in order to shear strip 30 on the fly upon rotation of drums 20, 22 while at the same time upper drum 20 is moved vertically downwardly. In this mode "III-Combination Shearing", strip 30 is travelling between drums 20, 22 which are rotated in opposite directions but in the same direction as the travel of strip 30. For sub-mode III(a), the axis of upper drum 20 is parallel to that of lower drum 22; however, the pressure value in piston cylinder assemblies 42 on both ends of upper drum 20 are such as to vertically move top knife 38 downwardly into and through strip 30 for the straight cutting action.

The second sub-mode III(b) positions the axis of upper drum 20 in a non-parallel positioning to that of lower drum 22, and assemblies 42 are operated to vertically move upper knife 38 down through strip 30 resulting in a rake cutting action. Sub-mode III(c) involves imparting a rocking motion to upper knife 38 in addition to applying the above mentioned high frequency oscillations to produce a rolling action and therefore a series of progressive transverse sectional cuts through strip 30. The types of movement for sub-modes III(a) through III(c) are designated by small letters x, y, and z. In the first two sub-modes, drums 20, 22 are rotated while upper drum 20 is moved vertically downwardly toward lower drum 22; and sub-mode III(c) involves these two movements x, and z; in addition to a rocking motion designated by the small letter y.

Each of the sub-modes in the three cutting operations I, II, and III are the same as a corresponding one in each main category, i.e. a straight cut down through the strip when drums 20, 22 are parallel is effected in sub-modes I(a), II(a), or III(a); a raking action down through the strip when drums 20, 22 are non-parallel is effected in sub-modes I(b), II(b), or III(b); and a rolling action with or without high frequency oscillations added to the rocking motion of upper drum 20 is effected as in sub-modes I(c), II(c), or III(c).

The stationary shearing, Mode I, will be used when rotary shearing is impossible either due to the abnormal material defects such as excessive "alligator mouth", excessive end "turn-up" or "turn-down", "cobble", or low material temperature. Rotary shearing Mode II will be used for material thicknesses up to 1.5 inch during normal operating conditions. Combination shearing Mode III will be used for material thicknesses up to 3.0 inch during normal operation conditions. The non-parallel knives mode, as well as the rocking knives mode, will be used to enhance the shearing process for material with excessive resistance to effecting a cut.

It will be appreciated that the Figures are schematic and that depending on the width of the material and the degree of rake, that the lower knife or lower drum may require a design that allows the upper knife to make the required descent.

Depending on the particular requirements for the kind of material to be sheared, a control system 56 including all or only a predetermined number of these three main modes I, II, and III and their related sub-modes may be adapted to operate the shearing apparatus 10 of the present invention. For all three modes, strip 30 is sheared along its width with a cut running substantially parallel to the axis of drums 20, 22 in a vertical plane. If no shearing is to be done, then upper drum 20 can be raised a distance sufficient for upper knive 38 to clear the top of strip 30.

Control system 56 is not disclosed herein in detail since such is not necessary to understand the disclosed form of the invention and can be one of several known systems such as a computer process control system coordinating the rotary, down cut and rocking movements. The coordination of these three movements of upper drum 20 is accomplished by control system 56 receiving signals from the position transducers 54; the pressure transducers (not shown) in cylinder assemblies 42 of upper drum 20; the drum angular position transducers (not shown); and devices (not shown) for measuring the current and speed in motor assemblies 36.

The input signals from the various measuring and detecting devices and the output signals are shown in more detail in FIG. 3D, which needs little explanation.

An example of a schematic for an electrical control for the selective part of the control system 56 suitable for use in the preferred embodiment of the present invention with the necessary modifications is disclosed in U.S. Pat. No. 4,004,459 incorporated herein by reference thereto.

In addition to the several different applications or modes of operation noted above, the present invention allows the shear 10 to be employed to perform several other important operations. In the case where a miscut is required, for example to cut different length cuts than what could be obtained by the single revolution of the drums, piston cylinder assemblies 42 can be operated so as to avoid contact by the knives 20, 22 to increase the length cut in multiples equal to the knife circle of the knives. In shears where there is a danger of over loading the shear thereby running the risk of breakage of its parts, the piston cylinder assemblies 42 can play the role of a safety mechanism whereby the set pressure thereof when exceeded will allow the knives 20, 22 to move away from the material during a cut which requires more shearing force than what the shear is capable of producing.

An additional use of the disclosed shearing design is found in the control of the piston cylinder assemblies and the displacement of the associated upper knife holder to vary the approach angle of the upper knife 20.

This feature may be used in Modes II and III when the thickness of the material is such that a larger than desired bite angle of the knife is created which would require excessively high shearing torque. To replace the lever arm (illustrated in FIG. 1 as L.A.) between the eventual point of contact with the material and the axes of the drums, the upper knife is first raised to allow it to engage the material later in the shearing stroke, and then lowered while the drums are rotating which would reduce the bite angle. In this action, the lower knife similarly delays its contact with the material to thereby reduce its bite angle.

When independent drives are used for rotation of drums 20, 22, control system 56 will be used for optimum mutual positioning of upper and lower knives 38, 40 respectively during the cutting action as a function of both the material resistance to shearing and its thickness.

In this connection, it is a feature of the present invention to control the relative speeds of the two drums to vary the knife gap, i.e. the distance between the vertical cutting surfaces 39, 41 respectively of knives 38, 40 whereas shown in FIG. 1 no gap exists. This adjustment can be made by various well known means which is schematically illustrated in FIG. 2 by element 58 associated with shaft 33 of upper knife 38 which sends a signal to main control system 56.

While the present invention has been discussed in connection with the embodiment thereof, and its designated uses, it should be understood that there may be other embodiments and uses which fall within the spirit and scope of the invention as defined by the following claims.

In accordance with the provisions of the patent statutes, we have explained the principle and operation of our invention and have illustrated and described what we consider to represent the best embodiment thereof.

We claim:

1. A shearing apparatus for selectively performing one of several desired cutting actions on material which may be in a stationary mode or a travelling mode, comprising:

a first drum having opposed ends and carrying a leading knife, a second drum having opposed ends and carrying a trailing knife, means for mounting said first and second drums at their respective opposed ends, said first and second drums further constructed and arranged in a manner to be spaced away from each other to form a gap for positioning said material therebetween during one of said two modes of said material and to cooperate with each other in said preselected desired cutting actions, means connected to said first and said second drums for rotating said drums in opposite directions relative to each other, and in the same direction as said material at substantially the same speed when said material is in its said travelling mode, means associated with said means for mounting said first and second drums for independently displacing each said opposed ends of at least one of said first and second drums to vary said gap and to position said at least one of said drums in a predetermined cutting relationship relative to its said cooperative drum, said means for rotation and said means for displacement being separate and distinct from each other and independently operable, means for controlling said rotation means and said displacement means constructed and arranged in a manner so that said rotation and said displacement may simultaneously be effected when said material is in its said travelling mode, whereby depending on which of said modes said material assumes, said rotation and displacement may be selectively effected to produce said desired cutting action on said material.

2. A shearing device according to claim 1, wherein said means for mounting said first and said second drums at their respective opposed ends comprises a pair of spaced housings, each located in a transverse direction across the width of said material for receiving one of said opposed ends of said first and second drums thereby positioning said drums transversely across the width of said material.

3. A shearing device according to claim 1, wherein said means for independently displacing said opposed ends of at least one of said first and second drums comprises an hydraulic piston cylinder assembly mounted at said opposed ends thereof.

4. A shearing device according to claim 3, wherein said at least one of said first and said second drums is positioned above said material and its said cooperative drum and wherein said material is generally in a horizontal plane.

5. A shearing device according to claim 1, wherein said control means for controlling said means for independehtly displacing said opposed ends of said at least one of said first and second drums further includes means for translationally moving said opposed ends of said at least one of said first and second drums in unison in a vertical plane a distance necessary to establish an initial parallel relationship between said axis of rotation of said first and said second drums prior to said desired cutting action.

6. A shearing device according to claim 1, wherein said control means for controlling said means for independently displacing said opposed ends of said at least one of said first and said second drums further includes means for translationally moving said at least one of said first and second drums in unison in a vertical plane a distance necessary to establish an initial non-parallel relationship between said axis of rotation of said first and said second drums prior to said desired cutting action.

7. A shearing device according to claim 1, wherein said control means for controlling said means for independently displacing said opposed ends of said at least one of said first and second drums further includes means for imparting a rocking motion in a translational direction in a vertical plane to said at least one of said first and second drums and selectively adding relatively high frequency oscillatory motion to said rocking motion during said desired cutting action.

8. A shearing apparatus according to claim 1, further comprising:

means mounted between said first and second drums for maintaining said formed gap therebetween.

9. A shearing apparatus according to claim 8, wherein said maintaining means for said gap consists of at least one hydraulic piston cylinder assembly located at said each opposed ends of said first and second drums.

10. A shearing apparatus for selectively performing more than one desired cutting action on the same material or different material offering different shearing charactertics or requirements, comprising:

a first and second knife holding means arranged on opposite sides of the material to effect a shearing thereof, an elongated knife means carried by each of said holding means arranged on their respective holding means to cooperatire together to effect a cut, means for supporting said holding means including means for rotating said each of said knife means in said each holding means and means for rectilinearly moving at least one of said holding means with one said knife means relative to the other to effect a cut, power means for selectively causing said rotational movement, said rectilinear movement or both said movements simultaneously of said holding means depending on said characteristics or requirements of said material to effect a cut, and means for selectively controlling said power means including means for effecting an operation of said power means to cause either said rotational or rectilinear movements.

11. A shearing apparatus according to claim 10, wherein said power means includes means for causing said opposite ends of one of said holding means to selectively assume a parallel or non-parallel condition relative to said material.

12. In a shearing device according to claim 10 wherein said means for controlling the operation of said power means includes means to perform a miscut.

13. In a shearing apparatus according to claim 10, said means for changing the shearing position of said one knife means including means for varying the rotational speed of one of said holding means during at least a part of a shearing cycle to vary the knife gap between said knife means during shearing.

14. A shearing apparatus for selectively performing more than one desired cutting action on the same material or different materials offering different shearing characteristics or requirements, comprising:

a first and second knife holding means arranged on opposite sides of the material to be sheared, an elongated knife means carried by each of said holding means arranged on their respective holding means to cooperate together to effect a cut, means for supporting said holding means in a manner that at least one holding means is movable relative to the other to effect a cut, and power means for causing the opposite ends of said one holding means to selectively assume a parallel or non-parallel condition relative to the material and for causing said relative movement of said one holding means to effect a cut while in one of said assumed position, and means for controlling said power means including means for effecting an operation of said power means to displace said one holding means away from the material and the opposite knife upon experiencing an excessive predetermined shearing load.

15. A shearing apparatus for selectively performing more than one desired cutting action on the same material or different materials offering different shearing characteristics or requirements, comprising:

a first and second knife holding means arranged on opposite sides of the material to be sheared, an elongated knife means carried by each of said holding means arranged on their respective holding means to cooperate together to effect a cut, means for supporting said holding means including means for rotating said each of said holding means and means for rectilinearly moving at least one said holding means relative to the other to effect a cut, power means for selectively causing said rotational movement, said rectilinear movement or both said movements simultaneously of said holding means depending on said characteristics or requirements of said material to effect a cut, and means for controlling said power means including means for effecting an operation of said power means to displace said one holding means away from the material and the opposite knife upon experiencing an excessive predetermined shearing load.

* * * * *